US005624292A

United States Patent [19]

Wiseman, Jr.

[11] Patent Number: 5,624,292

[45] Date of Patent: Apr. 29, 1997

[54] LADDER BRIDGE MAT

[76] Inventor: John H. Wiseman, Jr., 2625 Mas-Que Farm Rd., Annapolis, Md. 21403

[21] Appl. No.: 610,931

[22] Filed: Mar. 5, 1996

[51] Int. Cl.[6] ..... B63C 9/32

[52] U.S. Cl. ..... 441/80; 441/82

[58] Field of Search ..... 441/80, 82, 84, 441/129, 130, 66, 40; 114/345; 14/2.6, 27; 182/93, 207, 151

[56] References Cited

U.S. PATENT DOCUMENTS

| | | | |
|---|---|---|---|
| 482,402 | 9/1892 | Booth | 182/207 |
| 2,355,757 | 8/1944 | Spanel | 441/40 |
| 3,143,357 | 8/1964 | Krupnik | 441/130 |
| 4,047,257 | 9/1977 | Bondarchuk, Sr. | 14/27 |
| 4,145,786 | 3/1979 | Myers | 14/27 |
| 4,179,764 | 12/1979 | Lindblade | 14/27 |
| 4,742,590 | 5/1988 | Glassman et al. | 14/27 |
| 4,976,213 | 12/1990 | Smith | 114/345 |
| 4,990,114 | 2/1991 | LeBlanc, Jr. | 14/27 |

*Primary Examiner*—Sherman Basinger
*Attorney, Agent, or Firm*—Patent & Trademark Serv.; Joseph H. McGlynn

[57] ABSTRACT

An inflatable bag which can be attached to an ordinary ladder quickly and easily. Also, the bag can be used to secure multiple ladders together, thereby extending the distance a rescue team can go in order to rescue a victim. Also, since most fire department rescue teams already have ladders attached to their vehicles, the inflatable bags will not take up much of their valuable storage space. The bags can be inflated by a valve similar to a vehicle, or it can have a self inflating mechanism similar to an inflatable life boat. This means a substantial savings in time to assemble the equipment.

5 Claims, 2 Drawing Sheets

LADDER BRIDGE MAT

BACKGROUND OF THE INVENTION

This invention relates, in general, to lifesaving equipment, and, in particular, to equipment which can be used to rescue a person who has fallen through the ice.

DESCRIPTION OF THE PRIOR ART

In the prior art various types of lifesaving equipment has been proposed. For example, U.S. Pat. No. 4,047,257 discloses an apparatus for rescuing a person who has fallen through the ice, comprising a series of slabs flexibly connected together to form a long mat which can be unrolled unto the ice to reach a person off shore.

U.S. Pat. No. 4,145,786 discloses a portable floating apparatus having a plurality of platforms hinged together, so that the platforms can be extended to form an extendible bridge.

U.S. Pat. No. 4,179,764 discloses an inflatable flotation bag that can be attached to a ladder in order to extend the ladder out onto the ice.

U.S. Pat. No. 4,742,590 discloses a bridge set which can be rolled across an obstacle, such as a river, to form an extended bridge assembly.

U.S. Pat. No. 4,990,114 discloses an inflatable tube which can be extended onto the ice to rescue a person who has fallen through the ice.

All of the prior art devices suffer major drawbacks which the present invention is designed to overcome. The principal drawback is the amount of space required to store the prior art devices. Rescue squads need a device which will not be bulky or consume an inordinate amount of space in their rescue vehicles. Also, it should be capable of being assembled quickly, since in most rescue operations time is of the essence, and can mean the difference between life and death.

SUMMARY OF THE INVENTION

The present invention utilizes an inflatable bag which can be attached to an ordinary ladder quickly and easily. Also, the bag can be used to secure multiple ladders together, thereby extending the distance a rescue team can go in order to rescue a victim. Also, since most fire department rescue teams already have ladders attached to their vehicles, the inflatable bags will not take up much of their valuable storage space when deflated. The bags can be inflated by a valve similar to the valve on a vehicle tire, or it can have a self inflating mechanism similar to an inflatable life boat. This means a substantial savings in time to assemble the equipment.

It is an object of the present invention to provide a life saving device which can be used to rescue a person who has fallen through the ice.

It is an object of the present invention to provide a life saving device which can be easily and quickly assembled.

It is an object of the present invention to provide a life saving device which rescue squads can add to their equipment store without taking up valuable storage space.

These and other objects and advantages of the present invention will be fully apparent from the following description, when taken in connection with the annexed drawings.

DESCRIPTION OF THE PREFERRED EMBODIMENT

Figure 1:
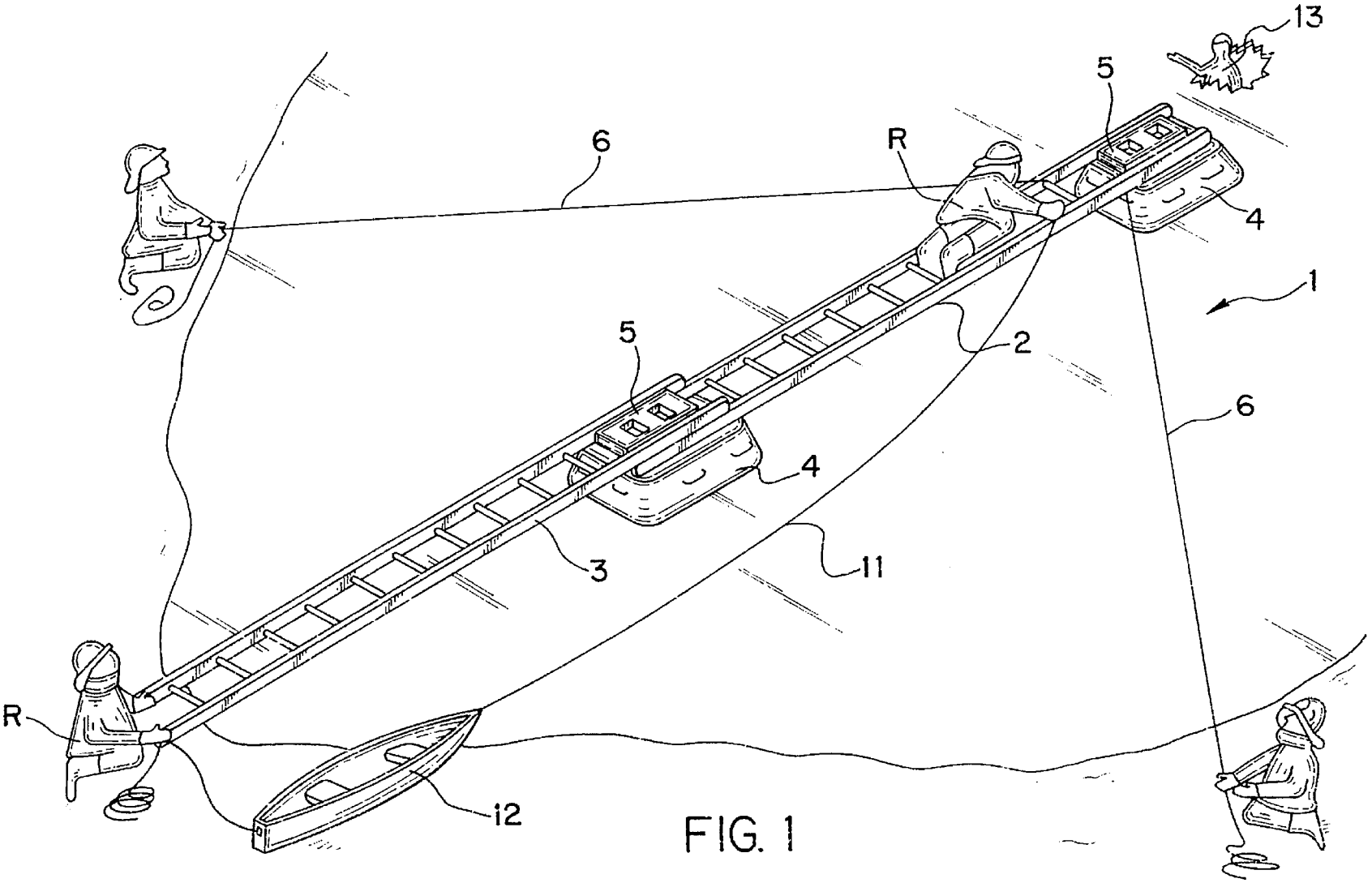
FIG. 1 is a view of the present invention used in a typical rescue operation.

Referring now to the drawings in greater detail, FIG. 1 shows a typical rescue scene where a person 13 has fallen through the ice. It should be noted that although the invention is shown in an ice rescue, it could also be used where a person has become stranded in open water close to shore. Since the bags 4 when inflated will float, they are capable of holding the ladder or ladders on top of the water in order to reach a victim. FIG. 1 shows rescuers R utilizing the present invention to reach the person 13 who has fallen through the ice. In this instance two ladders 2 and 3 have been secured together by an inflatable bag 4 of the present invention. A second bag 4 has been attached to one end of the ladder 2 in order to guide the end of the ladder toward the victim. Also, guide lines 6 can be attached to ladder 2 to help guide the ladders in the direction of the victim. Also, a line 11 could be carried by a rescuer which would be secured to a boat 12 or other type of float to aid in the rescue It should be understood that while two ladders are shown in FIG. 1, more than two ladders can be secured together to reach further from shore. Also, since the bags or mats 4 are inflatable they will float on the water. Therefore, if a person is away from the edge of the ice, the lead ladder, with the bag 4 attached, can be pushed into the water where it will float in order to reach the victim.

Figure 2:
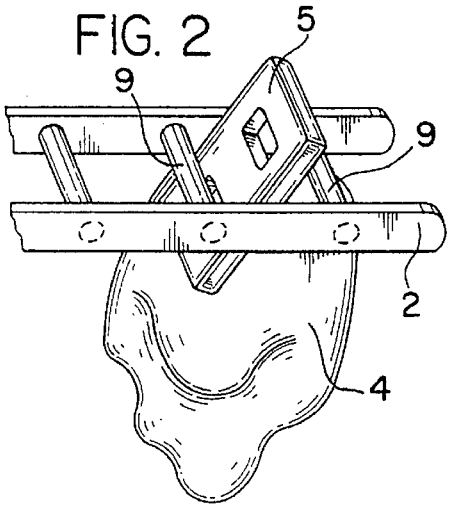
FIGS. 2–4 are views showing the present invention being attached to a ladder.
Figure 3:
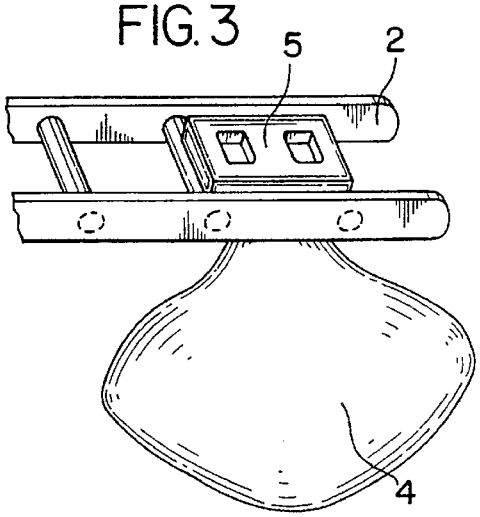
Figure 4:
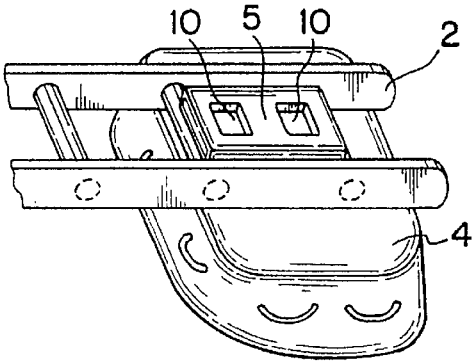
Figure 5:
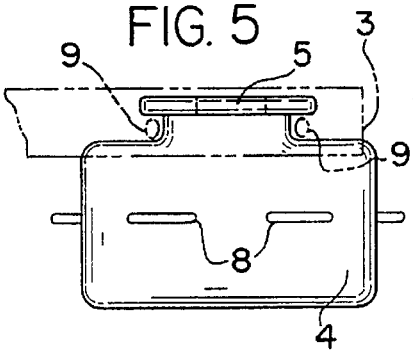
FIGS. 5 and 6 are side and front views of the inflatable bag of the present invention.
Figure 6:
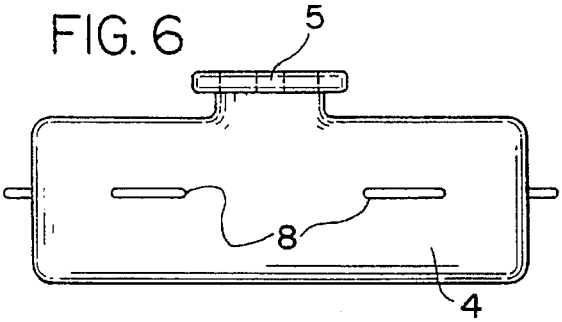

FIGS. 2–4 show a bag or mat 4 being attached to a ladder 2. The bag or mat 4 will be made from a pliable and durable material such as, but not limited to, reinforced nylon, and has a relatively rigid upper portion 5 which will be integrally attached to the bag 4 by any conventional means such as, but not limited to, vulcanizing.

In order to attach a bag 4 to a ladder 2, the rigid portion 5 will be tilted, as shown in FIG. 2, in order to pass the leading edge of the rigid portion between two adjacent rungs 9 on the ladder. The rigid portion and at least a part of the bag 4 will be passed between the rungs and then above the rungs, until the entire rigid portion is above the rungs 9.

Once the entire portion 5 is above the rungs, the uninflated bag will be pulled down until the bottom portion of the rigid portion 5 rests on the top of the rungs, as shown in FIG. 3. Each rigid portion 5 will have at least one aperture 10 which will allow the bags to be manipulated easier as the bag is being attached to the ladder.

Once the bag 4 is in position it can be inflated by any conventional inflation means such as, but not limited to, an air valve (not shown) but which is similar to a tire valve or, a compressed air cylinder (also not shown) which can be either built into the bag or can be a separate device which can be attached to a valve on the bag.

As the bag inflates it will be securely attached to the ladder. The rigid portion 5 will be too large to pass back through the ladder rungs without being tilted, as shown in FIG. 2, and the inflated bag, when inflated, will be firmly pressed against the bottom of the ladder which will firmly wedge the bag in place.

Figure 7:
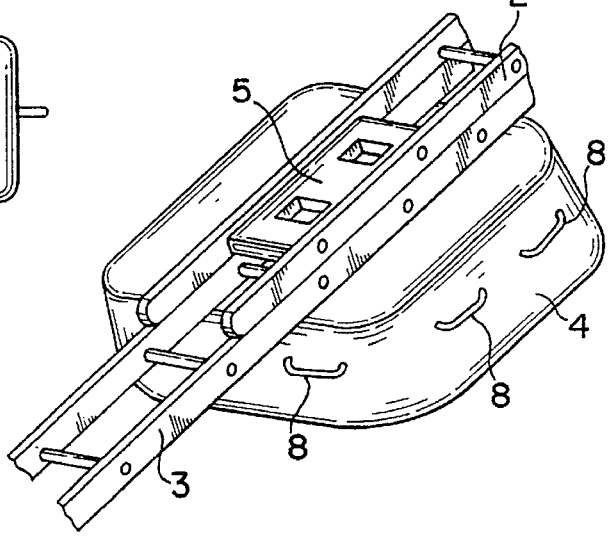
FIG. 7 is a view of the present invention used to connect two ladder sections together.

In addition the bag 4 can be used to secure two or more ladders together as shown in FIG. 7. The rigid portion 5 of the bag 4 will be passed through the first ladder 3 in the same manner as shown in FIG. 2. Then the rigid portion 5 of the bag 4 will be passed through the second ladder 2, and then the bag will be inflated. As the bag inflates, it will pull the ladders together and firmly secure them to each other. This will present a stable platform for rescuers to work from in order to reach a victim. Also, this application, i.e. securing multiple ladders together, will allow rescue workers to quickly and easily secure multiple ladders together in order to reach victims who are a great distance from shore.

Figure 8:
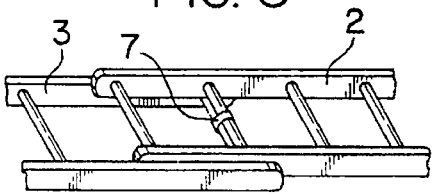
FIG. 8 is a view of another embodiment the present invention used to connect two ladder sections together.

In order to increase the stability of many ladders being attached together the rescue workers can attach a Velcro wrap around two rungs of adjacent ladders as shown in FIG. 8. Then when the bag 4 is attached to the ladders, the resulting structure will present a firm and stable platform from which a victim can be rescued.

Also, as shown in FIGS. 4–7, the bag or mat 4 can be attached with handles 8 which will give the victim, and if necessary, the rescuers something that can be easily grabbed during a rescue operation. Although the handles 8 are shown as loops in the figures, it should be understood that this is for illustration purposes only, and any shape of handle can be used without departing from the scope of the invention.

Although the ladder bridge mat and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A life saving device for use on ice or in the water comprising:

a platform having a length and a width and having at least one aperture, at least one inflatable flotation device adapted to be affixed to said platform, and wherein said platform is a ladder and said at least one aperture is a space between adjacent rungs on said ladder, said flotation device comprising two parts, one of said parts comprising a flexible enclosure means for holding a gas and, a second part integrally attached to said first part, said second part being rigid and having a length and a width which is larger than said at least one aperture in said platform, whereby said second part can be tilted into said aperture before said first part is inflated, and when said first part is inflated said flotation device will be securely attached to said platform.

2. The life saving device as claimed in claim 1, wherein said inflatable flotation device has handle means thereon for enabling rescuers or a victim to hold onto said life saving device.

3. The life saving device as claimed in claim 1, wherein said second part has at least one aperture means thereon for enabling manipulation of said inflatable flotation device.

4. The life saving device as claimed in claim 1, wherein at least two platforms are secured together by said inflatable flotation device.

5. The life saving device as claimed in claim 4, wherein said at least two platforms are additionally secured together by a wrapping means which is wrapped around two adjacent portions of said platforms.

* * * * *